US007341095B2

(12) United States Patent
Hirata et al.

(10) Patent No.: US 7,341,095 B2
(45) **Date of Patent: *Mar. 11, 2008**

(54) METHOD AND APPARATUS FOR MONITORING A MOLDING MACHINE

(75) Inventors: Minoru Hirata, Toyokawa (JP); Yutaka Hadano, Toyokawa (JP); Tsuyoshi Sakai, Toyokawa (JP)

(73) Assignee: Sintokogio, Ltd., Aichi-ken (JP)

( * ) Notice: Subject to any disclaimer, the term of this patent is extended or adjusted under 35 U.S.C. 154(b) by 109 days.

This patent is subject to a terminal disclaimer.

(21) Appl. No.: 11/208,520

(22) Filed: Aug. 23, 2005

(65) Prior Publication Data

US 2005/0279482 A1 Dec. 22, 2005

Related U.S. Application Data

(62) Division of application No. 10/485,882, filed as application No. PCT/JP02/07997 on Aug. 6, 2002, now Pat. No. 6,957,687.

(30) Foreign Application Priority Data

| | | |
|---|---|---|
| Aug. 6, 2001 | (JP) | 2001-237203 |
| Sep. 28, 2001 | (JP) | 2001-298699 |
| Feb. 6, 2002 | (JP) | 2002-029512 |

(51) Int. Cl.
*B22C 15/08* (2006.01)

(52) U.S. Cl. ..... 164/456; 164/154.2

(58) Field of Classification Search ..... 164/37, 164/154.1, 456, 154.2, 154.3, 154.8
See application file for complete search history.

(56) References Cited

U.S. PATENT DOCUMENTS

| | | | |
|---|---|---|---|
| 4,915,159 | A | 4/1990 | Damm et al. |
| 5,682,941 | A | 11/1997 | Oda et al. |
| 5,695,000 | A | 12/1997 | Uzaki et al. |
| 6,470,953 | B1 | 10/2002 | Hirata et al. |
| 6,662,855 | B1 | 12/2003 | Kaneto et al. |
| 6,749,003 | B2 | 6/2004 | Kaneto et al. |
| 6,752,196 | B2 | 6/2004 | Kaneto et al. |
| 6,883,582 | B2 | 4/2005 | Amano et al. |

FOREIGN PATENT DOCUMENTS

| | | |
|---|---|---|
| JP | 03-226352 | 10/1991 |
| WO | WO97/46342 | 12/1997 |

*Primary Examiner*—Len Tran
(74) *Attorney, Agent, or Firm*—Finnegan, Henderson, Farabow, Garrett & Dunner, L.L.P.

(57) ABSTRACT

A monitor system for monitoring a molding machine that includes a vertically-movable supporting frame, a pattern carrier on which a pattern is placed, a flask placed on a leveling frame, a sand hopper provided with an optional an air-jet chamber, sand-charging nozzles disposed around a plurality of squeeze feet that is disposed at a lower end of the sand hopper, and a filling frame connected to filling-frame cylinders and surrounding the squeeze feet and the sand-charging nozzles from their outside, the filling frame to be placed on the flask when lowered, comprising at least one sensor connected to the molding machine, for detecting an attribute of the molding sand as required and data analyzing monitor means connected to the sensor, for receiving data that correspond to the attribute detected by the sensor and analyzing the attribute and displaying the results of the analysis.

1 Claim, 14 Drawing Sheets

METHOD AND APPARATUS FOR MONITORING A MOLDING MACHINE

RELATED APPLICATIONS

This application is a divisional of U.S. application Ser. No. 10/485,882 filed Feb. 5, 2004 now U.S. Pat. No. 6,957,687, which is a §371 of International Application No. PCT/JP02/07997 filed Aug. 6, 2002, the contents of both of which are incorporated herein by reference.

FIELD OF THE INVENTION

This invention relates to a method and a system for monitoring a molding machine. The method and system of the invention includes a method and a system for monitoring a molding machine, wherein the method and system can receive and send data on the molding of the molding machine via a communication network.

DESCRIPTION OF THE PRIOR ART

WO 01/32333 A1 discloses a molding machine for producing a sand mold contained in a flask by executing primary squeeze and secondary squeeze using a leveling frame, which is vertically movably disposed around the pattern plate.

The molding machine includes a vertically-movable supporting frame installed across the upper ends of upright, frame-setting cylinders mounted on the machine base, a pattern carrier for carrying a pattern thereon to a place above the machine base, an annular, vertically slidable leveling frame surrounding the sides of the pattern plate, a flask to be placed on the leveling frame, a sand hopper suspended from the vertically-movable supporting frame, for containing molding sand therein, the hopper having an optional air-jet chamber for aeration, by which air is injected into the hopper to allow the molding sand to be floated and fluidized, a plurality of squeeze feet disposed at the lower end of the hopper, the squeeze feet being controlled to vertically move and stop, sand-charging nozzles disposed around the squeeze feet, for charging molding sand from the hopper into the flask, and a filling frame connected to filling-frame cylinders, for vertical movement so that it surrounds the squeeze feet and the sand-charging nozzles from their outside, and so that it is seated on the flask when moved down. Four cylinders are used, one for vertically moving the supporting frame, one for vertically moving the filling frame, one for vertically moving the leveling frame, and one for vertically moving the squeeze feet. Further, aeration is used to fluidize the molding sand in the sand hopper, and an auxiliary supply of compressed air is applied from above to the molding sand to charge it into the mold space through the sand-charging nozzles. Thus, by using many hydraulic and pneumatic pressures the molding machine is operated, that is, the elements of it are moved. The disclosure of WO 01/32333 A1 is incorporated herein for reference.

However, there is no means to check whether the elements are normally working, and usually a checker examines by his or her senses the elements, or actuating means, that work abnormally or that has come not to work. Accordingly, whether the elements, or actuating means, are working properly and sufficiently, or they are functioning well, so that the molding machine produces a sandmold as desired, cannot be detected even if any defect is found.

The present invention is created in view of such circumstances. The purpose of it is to provide a system and a method for monitoring the status of the operation of the elements or actuating means of the molding machine.

Another purpose of the present invention is to provide a system and a method for monitoring the status of the operation of the elements or actuating means of the molding machine via a remote unit.

SUMMARY OF THE INVENTION

In one aspect of the present invention the monitoring system is a system for monitoring a molding machine when producing a sandmold contained in a flask by using a molding machine that includes the vertically-movable supporting frame installed across upper ends of frame-setting cylinders mounted on a machine base; a pattern carrier for carrying thereon a pattern plate to a place above a central part of the machine base; an annular leveling frame for surrounding the sides of the pattern plate and for vertical sliding; the flask to be placed on the leveling frame; a sand hopper suspended from the vertically-movable supporting frame, for holding molding sand therein, the sand hopper selectively having an air-ejecting chamber therein to eject an air-jet for aeration by which the molding sand is floated and fluidized; a plurality of squeeze feet disposed at the bottom of the sand hopper, the squeeze feet being controllable to vertically move and stop; sand-charging nozzles disposed around the squeeze feet, for introducing the molding sand-from the sand hopper into the flask; a filling frame vertically movably connected to filling-frame cylinders, for surrounding the squeeze feet and the sand-charging nozzles from their outside and for being placed on the flask when moved downwardly; the system comprising at least one sensor connected to the molding machine for detecting an attribute as required on the molding machine; a local unit connected to the sensor and a communication network, for receiving signals corresponding to the attribute detected by the sensor and sending the signals over the communication network; and a remote unit connected to the communication network, for monitoring the attribute by receiving the signals from the local unit, displaying values on the attribute, analyzing the attribute, and displaying the results of the analysis.

In another aspect of the present invention the monitoring system is a system for monitoring a molding machine when a sand mold contained in a flask is produced by the molding machine, which includes a vertically-movable supporting frame installed across upper ends of frame-setting cylinders mounted on a machine base; a pattern carrier for carrying thereon a pattern plate to a place above a central part of the machine base; an annular leveling frame for surrounding the sides of the pattern plate and for vertical sliding; the flask to be placed on the leveling frame; a sand hopper suspended from the vertically-movable supporting frame, for holding molding sand therein, the sand hopper selectively having an air-ejecting chamber therein to eject an air-jet for aeration by which the molding sand is floated and fluidized; a plurality of squeeze feet disposed at the bottom of the sand hopper, the squeeze feet being controllable to vertically move and stop; sand-charging nozzles disposed around the squeeze feet, for introducing the molding sand from the sand hopper into the flask; a filling frame vertically movably connected to filling-frame cylinders, for surrounding the squeeze feet and the sand-charging nozzles from their outside and for being placed on the flask when moved downwardly; the system comprising at least one sensor connected to the molding machine for detecting an attribute as required on the molding machine; a data-analyzing monitor means connected to the sensor, for receiving signals corresponding to the attribute detected by the sensor and analyzing the attribute to display the results of the analysis.

The attributes of the molding sand includes the oil pressures of the hydraulic cylinders for actuating the frame-setting cylinders, the filling-frame cylinders, the cylinders for the leveling frame, the pneumatic pressure of the auxiliary air injected from above into the sand hopper and the pressure of the air in the flask or the filling frame, and positions of the frame-setting cylinders and the filling-frame cylinders.

According to the present invention, the status of the operation of the machine can be found from a place remote from a foundry. This will make it possible that one need not really go to the foundry. Further, since one can obtain information on the status of the daily operation of the molding, he or she can use it for quality control, maintenance, and trouble shooting for the operation and quickly repair the molding machine or do the like when it works abnormally.

For example, since the data on the oil pressures of the frame-setting cylinders, filling-frame cylinders, and hydraulic cylinders for actuating the leveling frame are collected (or obtained) from the molding machine while it is actually working, the relationship between a produced mold and the pressures can be obtained, and thus a proper value for each oil pressure can be set or such a value may be modified.

For a further example, since the data on the pressures of the aeration, the auxiliary air, and the air in the flask are collected from the molding machine when it operates, the relationship between a produced mold and the pressures can be obtained, and thus a proper value for each oil pressure can be set or such a value may be modified. Further, since these pressures are displayed, one can easily repair an abnormal operation. This allows the machine to stably work to produce a product of a good quality.

For a further example, since the data on the positions of the frame-setting cylinders and the filling-frame cylinders are obtained by using encoders from the molding machine when it operates, the relationship between a produced mold and the positions of the frame-setting cylinders and the filling-frame cylinders can be obtained, and thus the speed of them can be calculated and displayed. Thus this enables the machine to stably work to produce a product of a good quality.

Since in the molding machine of the present invention, which produces a mold contained in a flask, the vibrations of the machine are detected by a vibration sensor, since the temperature of the molding sand is detected by a thermometer, and since these data are collected from the machine while it is operating, an abnormal operation will be displayed when the data are not within the allowable limits. Accordingly, any trouble in the machine will be readily found, and hence the damage would be minimum.

In this invention the local unit, which is one that is installed in a controller (a sequencer) of the molding machine or disposed adjacent to the controller, has a function wherein the order to it is changed (or modified) by a user command from a remote place by using software installed in the unit. Namely, from a remote place the setting for the local unit may be changed or modified to modify the measuring standard, special limitations, or programming variations. For example, decision means, which includes software and a comparator connected to a processor, is used to judge whether such variations are proper. And if they not within the proper range they will be changed.

The communication network in the present invention is used between the local unit and the remote unit. This communication network may be telephone line for ISDN or the like, a cellular phone, a portable telephone, or the Internet. The means to access the network may be a modem operatively coupled to the local unit.

The remote unit is connected to the local unit via the communication network, and receives the signals from it. The remote unit also displays the detected attributes of the molding machine. Accordingly, when the molding machine is operated to produce a sand mold, it can be monitored at a remote place. The remote unit includes a facsimile, a portable telephone, and any other mobile communication devices. The remote unit has the function to analyze the detected signals to judge whether the measuring standard is correct, as the local unit does the same, and also a displaying function.

The data-analyzing monitor means in this invention may be installed in a controller (a sequencer) of the molding machine or disposed adjacent the controller, to receive the signals from sensors and the molding machine and to display the detected attributes of the molding machine.

Further, the data-analyzing monitor means in this invention has the function to receive the signals representative of the attributes detected by the sensors as required and to display the desired values for the molding machine and the analyzed results. The analysis will be carried out as described below.

The positions and the pneumatic and hydraulic pressures of the frame-setting cylinders, the filling-frame cylinders, and the cylinders for the leveling frame, which are analog amounts, are sent to an input/output board via signal wires, and then converted into digital amounts by the board. The digital amounts are then input in the data analyzing monitor means.

All kinds of data for the molding machine when it is working properly are previously memorized in the data-analyzing monitor means, and the monitor means then compare the data detected for each operation with the memorized data to see if the detected data are within the allowable limits. To this end, for example, the points of inflection of the normal data and the inclinations of the lines, each connecting two points of inflection, are obtained by using software, and 10% is set as allowable limits for them. The data on each operation are then checked to see if they are within the limits.

Further, the data-analyzing monitor means has the function wherein its software is modified by a user command sent from a remote place via the communication network.

The setting of the specific limitations or the programming variations of the data-analyzing monitor means may be directly changed.

Further, by not depending on an operator or a command, but by using decision means, which is comprised of software interfaced with a processor, whether the measuring standard and so on are correct is checked, and if any of them is not within the allowable limits, the variations, etc. will be changed.

In detail, in the monitor system each kind of data for the machine is memorized while it is normally operating, and the data on each operation are then detected and checked to see if they are within the allowable limits. The monitor system has a function to automatically change the order for the operation of the molding machine via a controller if the detected data are not within the limits.

In another aspect of the present invention the monitoring method is a method of monitoring a molding machine, comprising the steps of memorizing, before it starts to produce a sandmold by a molding machine that operates properly, data, which varies over time, on power-transmitting media of actuating means for actuating an element of the molding machine, or specified design data on an element of the molding machine, as target data in a computer; after memorizing the target data, memorizing data on the power-transmitting media, which varies over time, and which are obtained when a sandmold is actually produced by the molding machine as detected data in the computer; after memorizing the detected data, comparing the detected data with the target data to obtain the difference between the detected and target data; and estimating from the obtained difference a cause of the element that is working abnormally.

In the present invention the actuating means includes a hydraulic and pneumatic cylinder and a servo-cylinder. Further, the power-transmitting media includes compressed air, compressed oil-fluid, and electricity, and the detecting means is a device that includes at least one of a displacement measuring instrument, flow sensor, vibration sensor, pressure sensor, thermometer, voltmeter, and ammeter.

DESCRIPTION OF THE PREFERRED EMBODIMENTS

Figure 1:
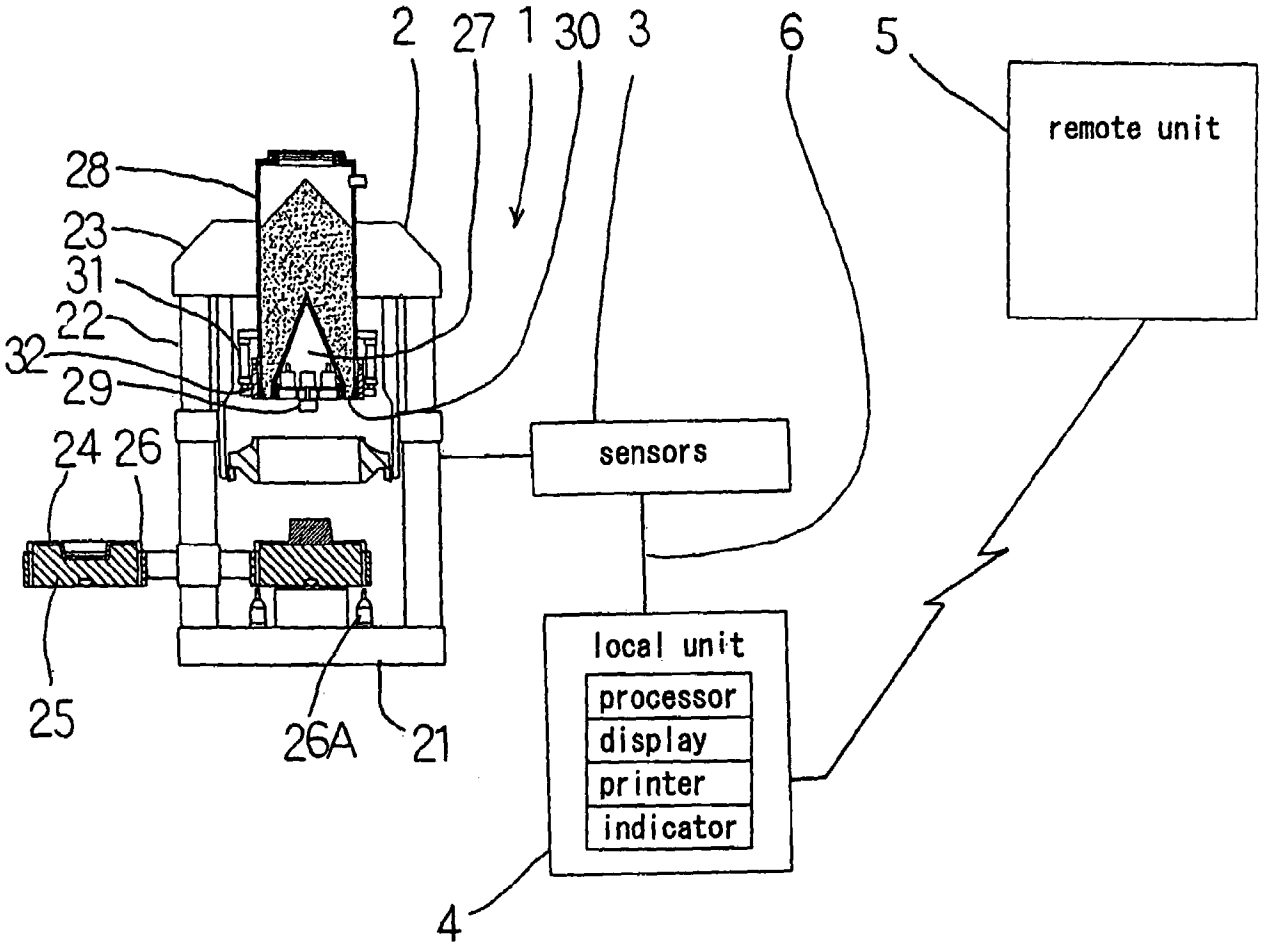
FIG. 1 is a schematic view showing an embodiment of a molding monitor of the present invention.

Below some embodiments of the present invention will be explained by referring to the drawings. In the drawings the same reference numbers are assigned to the same or similar elements.

First Embodiment

FIG. 1 shows a schematic structure of a molding machine and hardware of the embodiment of the present invention. A molding monitor system 1 of the embodiment of the invention shown in FIG. 1 is provided with some kinds of sensors 3 for measuring or detecting attributes of a molding machine 2. The sensors 3 are connected via a signal wire or wires 6 to a local unit 4, which in turn is connected to a remote unit 5.

The molding machine 2 of the embodiment of the present invention includes a molding base 21, frame-setting cylinders 22 mounted on the base 21 at the right and left thereof, a vertically-movable supporting frame 23 installed across the upper ends of the frame-setting cylinders 22, a pattern carrier 25 that carries a pattern plate 24 to a place above the central portion of the molding base 21, an annular leveling frame 26 for surrounding the pattern plate 24 located above the base 21 and for vertically sliding along the sides of the pattern plate 24, a flask F suspended from the vertically-movable supporting frame 23, a sand hopper or tank 28 supported by the vertically-movable supporting frame 23, which sand hopper may selectively have an air-jet chamber 27 for aeration, by which aeration jet air is applied to allow the particles of molding sand S in the hopper to be floated and fluidized, a plurality of squeeze feet 29 arranged at the bottom of the sand hopper 28 such that they are controlled to be vertically moved and stopped, sand-charging nozzles 30 arranged around the plurality of squeeze feet 29, and a filling frame 32 connected to filling-frame cylinders 31 and arranged to be vertically moved outside the squeeze feet 29 and the nozzles 30.

In this embodiment the molding machine may be one that does not use aeration, if only oil pressure is to be used and detected.

Molding by the molding machine 2 of the embodiment is carried out as explained below.

First, molding sand S is introduced into the sand hopper 28. An air jet may be selectively ejected from the sand hopper for aeration to allow the sand S to be floated and fluidized. A mold space is then defined by the pattern plate 24, leveling frame 26, flask F, filing frame 32, and the squeeze feet 29 which are arranged in a shape that corresponds to the concave and convex shape of the pattern plate 24. The molding sand S is aeration-charged into the defined mold space by using air via the sand-charging nozzles 30.

The squeeze feet are then lowered into the molding sand charged into the mold space to primarily squeeze it, and the leveling frame is lowered, while the squeeze feet 29, filling frame 32, and the flask F are lowered together toward the pattern plate 24, to thereby secondarily squeeze the molding sand S.

Further, a molding monitor system 1 of the molding machine 2 of the embodiment is arranged as explained below.

The local unit 4 may be a molding monitor system, as hardware that includes a processor, a display, a printer, and an indicator. The display, the printer, and the indicator may be selectively used, but it is not essential that they be used. In the embodiment a personal computer is used as the local unit.

A sensor or sensors 3 are connected to the local unit 4 via a signal wire or wires 6, which wire or wires send the signals created by the sensors to an input/output board (not shown). The input/output board is a signal processing system for converting the signals from the sensors to those convenient to the local unit 4 or the remote unit 5. Further, the local unit 4 is connected to a memory or storage (not shown), and the numerical data from the sensors 3 are stored in the memory.

Further, the means to access a communication network is, for example, a modem (not shown) operatively coupled to the local unit 4. In this embodiment of the invention the remote unit 5 is a personal computer provided with software installed therein that graphs out the detected pressures.

The operation of the embodiment of the invention configured as explained above is now explained.

Figure 2:
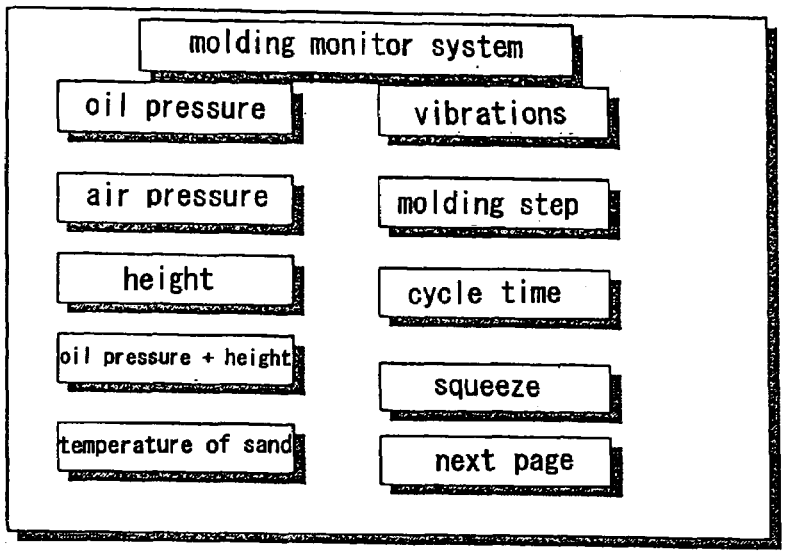
FIG. 2 shows an example of a screen of the molding monitor used in the embodiment of the invention.

In FIG. 2 an example of the initial screen of a molding monitor of the remote unit 5 is shown. In the molding monitor system of the invention some desired monitor functions can be selected from a number of monitor functions. When the molding machine is operated, some kinds of sensors 3,3 detect or measure some kinds of attributes, and the data on the detected or measured attributes are sent to the local unit 4 and from it to the remote unit 5, and are displayed on the screen of the display. What is displayed is not only the detected attributes but also any analyzed result obtained by the analyzing function of the remote unit 5.

According to the above embodiment, by each time storing in the memory or storage the data on regular or preventive maintenance of the molding machine 2, better maintenance can be kept, as for example, excessive repairs can be prevented, or stoppage of the product line due to excessive usage of the line, which would finally result in worse efficiency, can be prevented.

Second Embodiment

Figure 3:
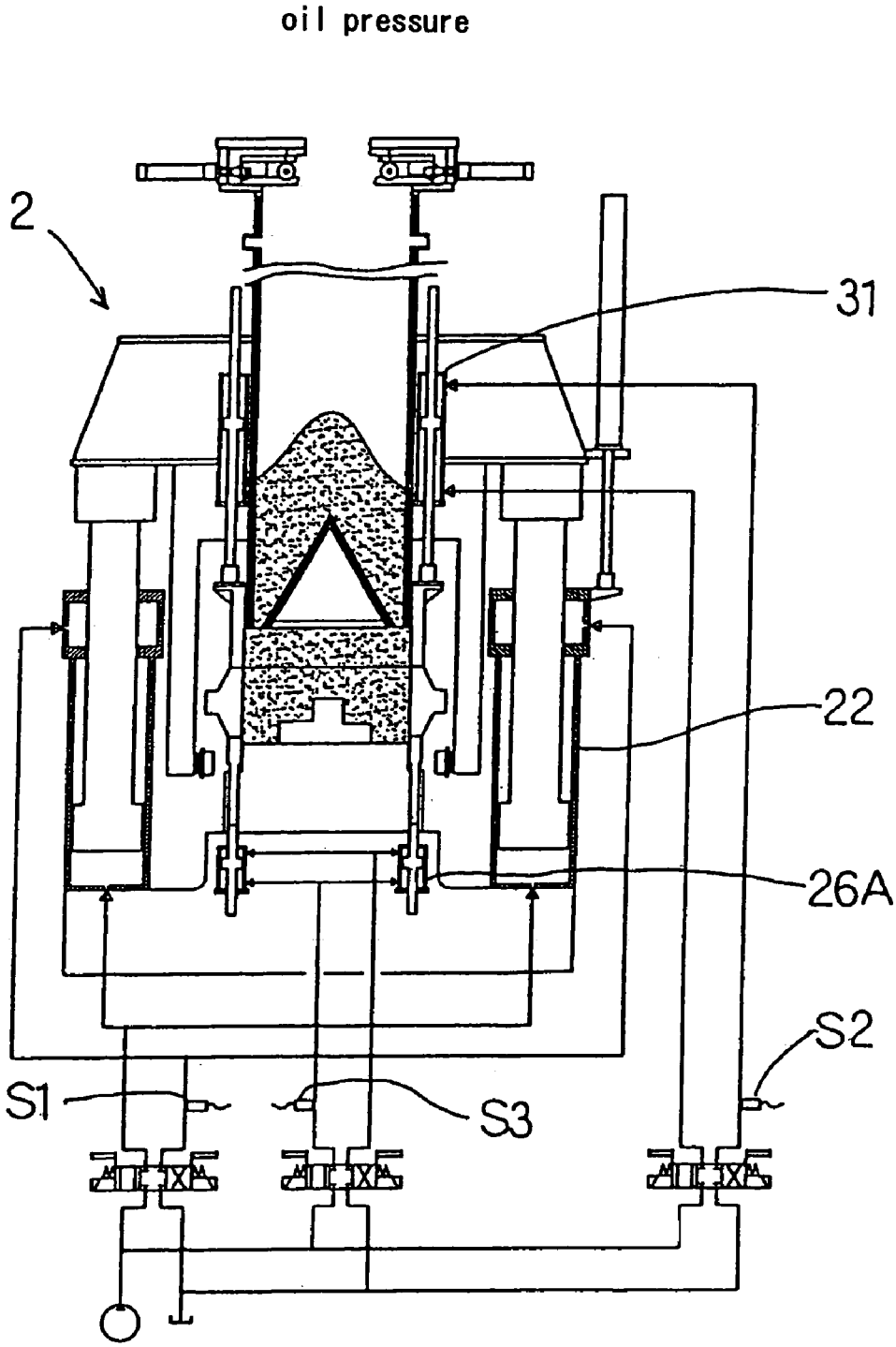
FIG. 3 shows an example of a molding machine used in the embodiment of the invention.

Another embodiment of the present invention is now explained by reference to some drawings. In FIGS. 1 and 3 the local unit 4 is provided with sensors for detecting the attributes on the squeeze of the molding machine 2. These sensors are pressure sensors S1, S2, and S3 for detecting the pressure of the working fluid of the frame-setting cylinders 22, filling-frame cylinders 21, and cylinders 26A for actuating the leveling frame 26, respectively. All other arrangements are similar to the first embodiment.

The operation of the second embodiment is now explained. In the molding monitor system 1 the monitor function for the oil pressure may be selected from many functions (FIG. 2) in the screen of the remote unit 5. When the molding machine 2 is operating, the monitor function for the oil pressure displays the detected values from the sensors S1, S2, and S3 for the frame-setting cylinders 22, filling-frame cylinders 21, and cylinders 26A for the leveling frame 26.

Figure 4:
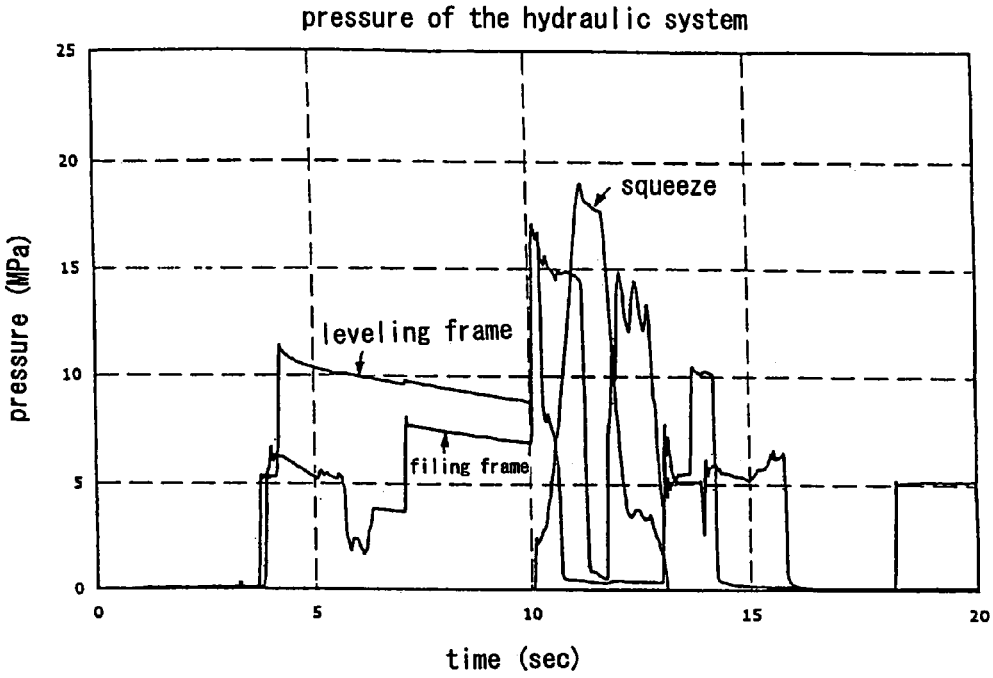
FIG. 4 shows an example of the function of the molding monitor used in the embodiment of the invention.

FIG. 4 is a graph of an example of the oil pressure displayed on the screen of the molding monitor of the remote unit 5. Since the molding machine 2 and the local unit 4 are connected to the remote unit 5 via a communication network, the remote unit 5 receives the signals from the local unit 4 via the network and displays the attributes of the molding machine 2 detected by the sensors. Thus, this enables one to monitor the oil pressure when the molding machine 2 produces a mold.

Since in the second embodiment of the invention the oil pressures of the fluid of the frame-setting cylinders 22, filling-frame cylinders 31, and the cylinders 26A for the leveling frame 26 are collected from the molding machine 2 during its operation, the relationship between the produced mold and pressures is obtained. Thus the value of each oil pressure can be appropriately set. Further, since these pressures are shown, the value for each pressure can be varied to produce a mold of good quality.

In particular, since in the molding machine 2 of the second embodiment the characteristics of a produced mold, particularly, the hardness of the mold near the flask, changes depending on the timing of lowering the frame-setting cylinders 22 and the leveling frame 26, it is important to detect the timing and display it when required. In other words, by selecting the adequate timing of shifting from the primary squeeze to the secondary squeeze, a good mold is produced. Further, the timing of actuating the filling-frame cylinders 31 and the leveling frame is very important when a-produced mold is demolded.

Third Embodiment

Below another embodiment of the present invention is explained by reference to some drawings.

Figure 5:
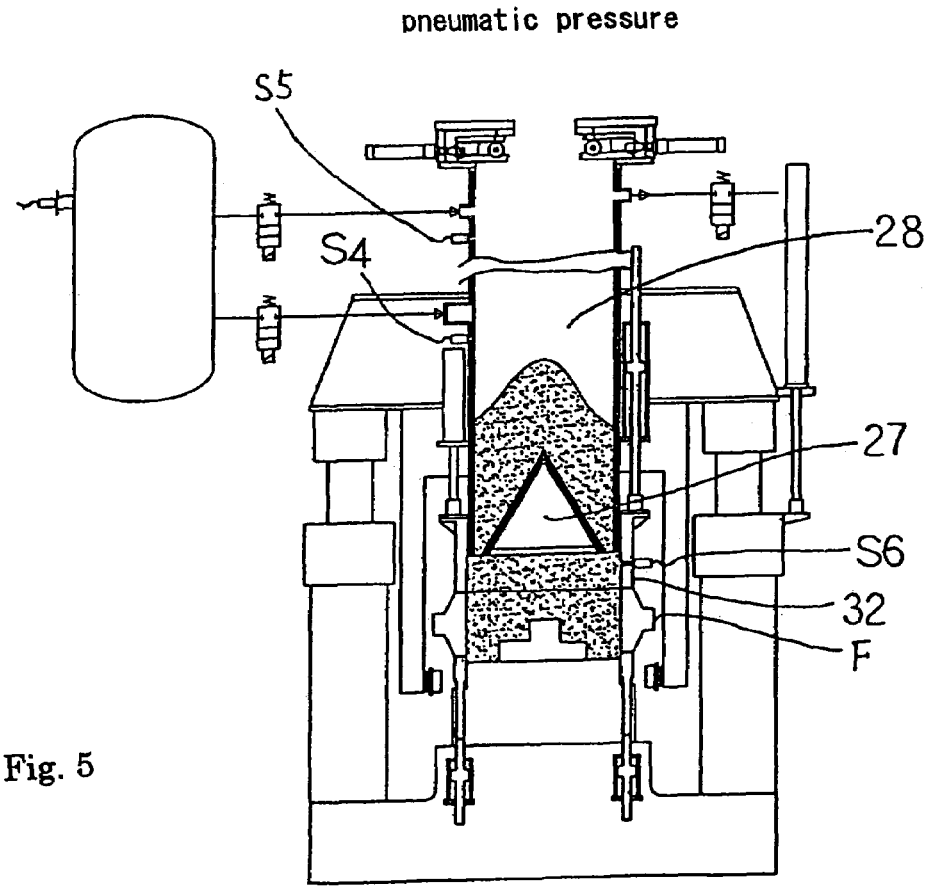
FIG. 5 shows an example of the molding machine used in the embodiment of the invention.

In FIGS. 1 and 5 the local unit 4 has sensors 3 for detecting pneumatic pressures of the molding machine. The sensors 3 are sensors S4, S5, and S6 for detecting the pressure of the air of the aeration from the central portion of the sand hopper 28 or air-jet chamber 27, the pressure of the auxiliary air from the upper part of the sand hopper 28, and pressure of the air in the flask F or filling-frame 32, respectively. All other arrangements are similar to the first embodiment.

The operation of the third embodiment is now explained. The remote unit 5 of the molding monitor system 1 can select the function for air pressure (pneumatic pressure) from its many monitor functions. When the molding machine 2 operates, the monitor function for the pneumatic pressure sends the signals from the pressure sensors S4, S5, S6 (sensors 3) to the local unit 4, which sensors detect the attributes on the pressures of the air for the aeration and the auxiliary air (in the sand hopper 28), and pressure of the air in the frame (i.e., the flask and the filling frame), for the molding machine 2. Further, since the local unit 4 is connected to the remote unit 5 via the communication network, the remote unit 5 receives the signals from the local unit 4 via the network and displays the pneumatic pressures detected by the sensors 3, thereby monitoring the pneumatic pressures when a mold is produced by the molding machine 2.

Figure 6:
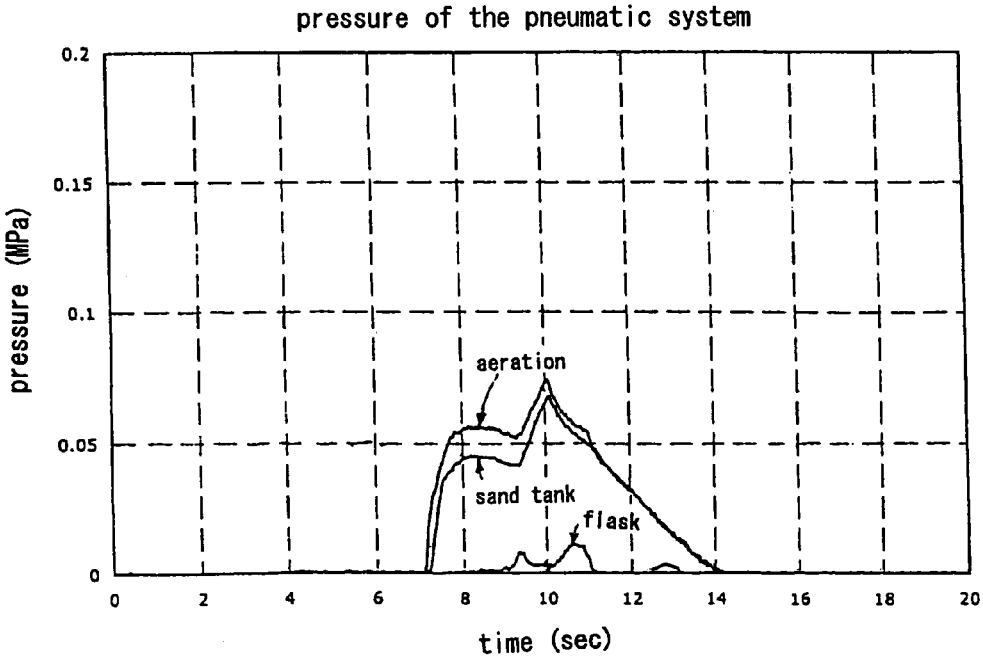
FIG. 6 shows an example of the function of the molding monitor, i.e., a graph of an example of the result of detections over time by using air pressure sensors.

FIG. 6 shows an example of a graph displayed on the screen of the function for the pneumatic pressure. The ordinate axis shows time, and the abscissa axis shows pressure. In the molding machine 2 of this embodiment, which produces a mold retained in a flask, molding sand can be introduced into a mold space by using auxiliary air, the pressure of which is lower than that used for normal blow-squeeze. Thus, the molding machine uses aeration to fluidize the-molding sand, wherein the auxiliary air and the aeration are balanced to enable small holes to be charged with molding sand, although such a charging cannot be achieved by the normal blow-squeeze, to enhance the uniformity of a produced mold. Accordingly, it is important to detect the pressures of the auxiliary air (the air in the sand hopper 28) and the air of the aeration and display them as required. Further, the state of the mold is memorized. By appropriately balancing the pressures of the auxiliary air and the air of the aeration as stated above, a good mold is be produced. Further, the pressure of the air in the frame (the flask and the filling frame) is very important in molding using static pressure. Thus it is important to monitor the pressure in the frame.

Fourth Embodiment

Figure 7:
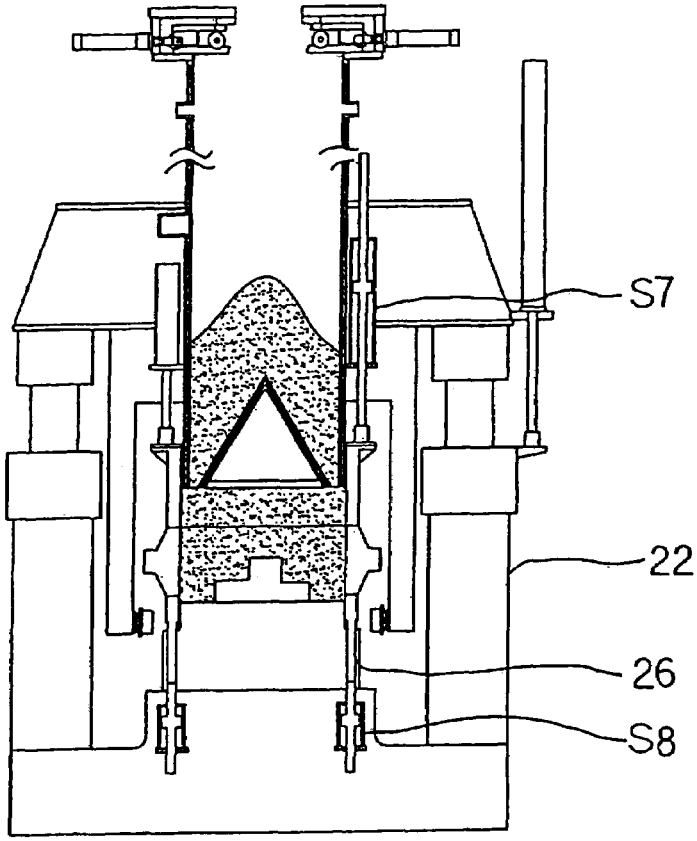
FIG. 7 shows an example of the molding machine used in the embodiment of the invention.

Another embodiment is now explained by reference to some related drawings. In FIGS. 1 and 7 the local unit 4 has sensors 3 for detecting the attributes on the squeeze by the molding machine 2. These sensors 3 are position sensors S7 and S8 for detecting the positions of the frame-setting cylinders 22, filling-frame cylinders, and leveling frame 26. All other arrangements are similar to those of the first embodiment.

The operation of the embodiment is now explained. The molding monitor system 1 can select from many monitor functions the functions of monitoring the positions of cylinders and so on. The position monitoring function detects and monitors the positions of the frame-setting cylinders, filling-frame cylinders, and the leveling frame by using encoders.

Figure 8:
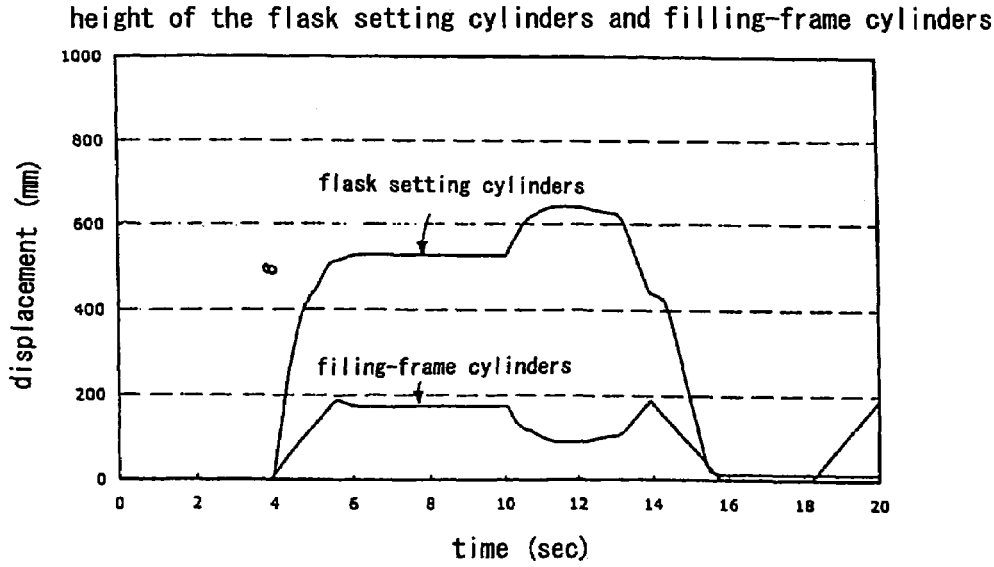
FIG. 8 shows an example of the function of the molding monitor used in the embodiment of the invention, i.e., a graph of an example of the results of the measurements over time by using an encoder-type displacement measuring instrument.

FIG. 8 shows an example of the screen of the position monitoring function. The ordinate axis shows time, and the abscissa axis shows displacement. In the molding machine 2 of this embodiment, which produces a mold retained in a flask, by monitoring the positions of the frame-setting cylinders, filling-frame cylinders, and leveling frame the height of the parting plane of the mold can be detected, and hence only defective mold can be detected. Thus it is important to detect the positions of the frame-setting cylinders and filling-frame cylinders and display the positions when required. Namely, by monitoring the positions of the frame-setting cylinders, filling-frame cylinders, and leveling frame the height of the parting plane can be detected, and any defective molds can be detected. In such defective molds, by memorizing the positions of the frame-setting cylinders and filling-frame cylinders, the cause or causes of the defective molds can be easily analyzed.

Fifth Embodiment

Another embodiment of the present invention is now explained by reference to some related drawings. Although in any of the embodiments 2, 3, and 4 the subjects to be displayed are classified as sensors for detecting the pressures of oil and air and position sensors, the subjects may be classified and displayed separately into some functions such as squeeze and sand introduction, or they may be combined.

Figure 9:
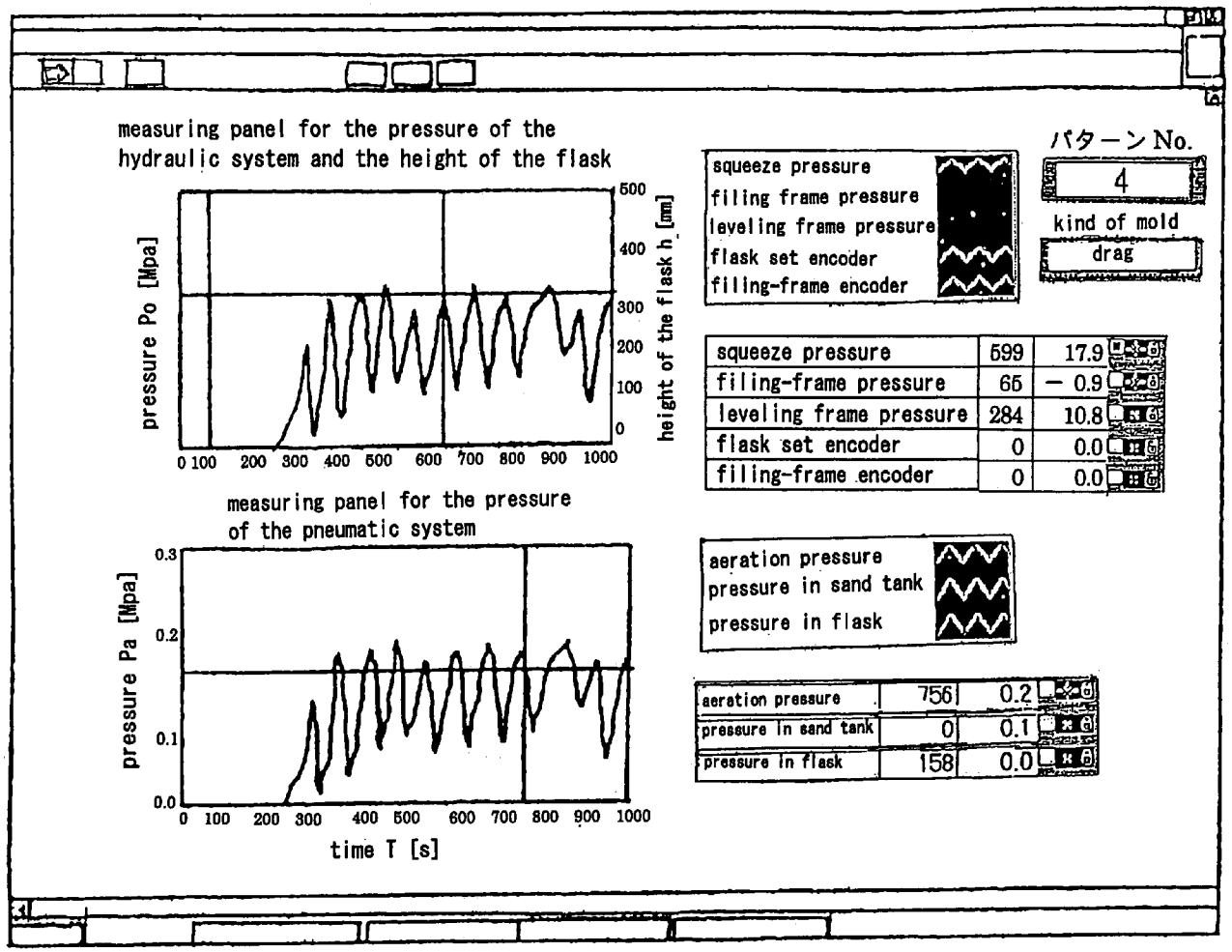
FIG. 9 shows an example of the function of the molding monitor used in the fifth embodiment of the invention.

FIG. 9 shows an example of the display screen that is used. All other arrangements are similar to those of embodiment 1. The molding monitor system having the structure explained above simultaneously displays the oil pressure and the height. This embodiment enables one to more accurately find the quality of a mold.

Figure 10:
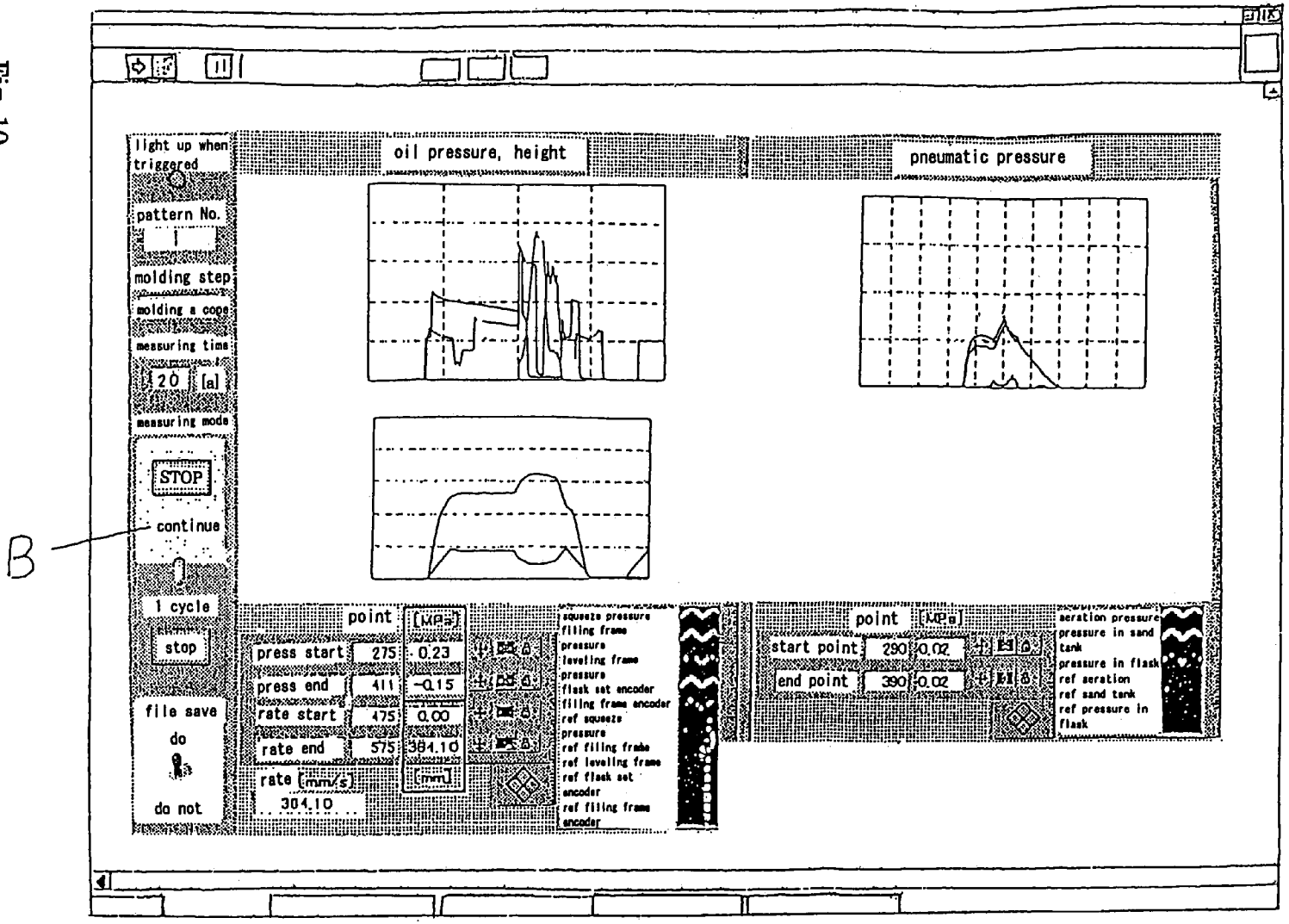
FIG. 10 shows another example of the function of the molding monitor used in the fifth embodiment.

In the fifth embodiment, by using switch B collecting the data on the status of the operation can be done continuously or only for one cycle, as shown in FIG. 10.

Sixth through Ninth Embodiments

The sixth through the ninth embodiments of the present invention are now explained by reference to FIG. 11 and FIGS. 2-8.

Sixth Embodiment

Figure 11:
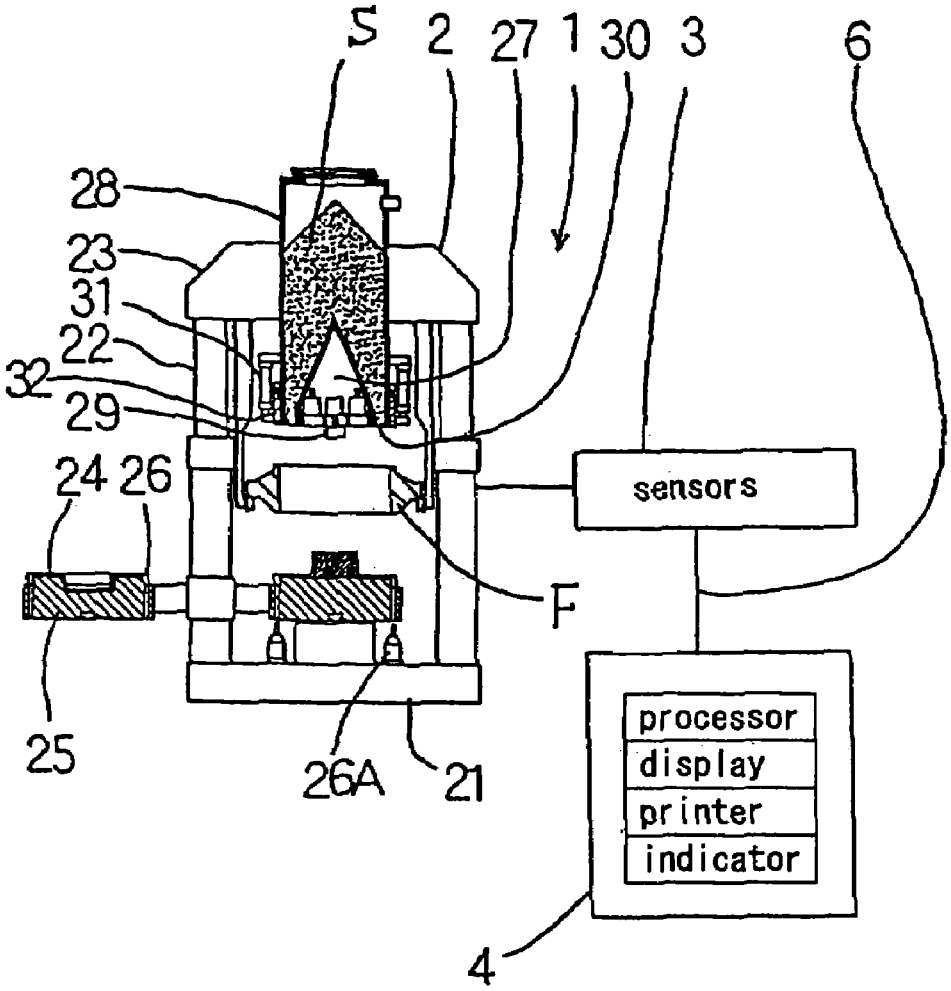
FIG. 11 is a schematic view showing another embodiment of the molding monitor of the present invention.

FIG. 11 is a schematic view showing a molding machine and other hardware of the embodiment. In FIG. 11 the molding monitor system 1 is provided with some sensors 3 for detecting the attributes as required of the molding machine 2. These sensors 3 are connected to a data-analyzing monitor means 54 via a signal wire or wires 6.

The molding machine 2 of the embodiment has a molding base 21, frame-setting cylinders 22 mounted on the base at the right and left thereof, a vertically-movable supporting frame 23 installed across the upper ends of the frame-setting cylinders 22, a pattern carrier 25 that carries a pattern plate 24 to a place above the central portion of the molding base 21, an annular leveling frame 26 for surrounding the pattern plate 24 located above the base 21 and for vertically sliding along the sides of the pattern plate 24, a flask F, a sand hopper 28 supported by the vertically-movable supporting frame 23, which sand hopper may selectively have an air-jet chamber 27 for aeration, by which jet air is applied to allow the particles of molding sand S in the hopper to be floated and fluidized, a plurality of squeeze feet 29 arranged at the bottom of the sand hopper 28 such that they are controlled to be vertically moved and stopped, sand-charging nozzles 30 arranged around the plurality of squeeze feet 29, and a filling frame 32 connected to filling-frame cylinders 31 and arranged to be vertically moved outside the squeeze feet 29 and the sand-charging nozzles 30.

Molding by the molding machine 2 of this embodiment is carried out as explained below.

First, molding sand S is introduced into the sand hopper 28. Aeration is then selectively done, wherein an air-jet is injected in the hopper 28 to allow the particles of the molding sand S to be floated and fluidized. The molding sand S is charged through sand-charging nozzles 30 by injecting air into a mold space that is defined by the pattern plate 24, the leveling frame 26, the flask F, the filling frame 32, and the squeeze feet 29 that have been arranged in a concave and convex shape corresponding to the concave and convex shape of the pattern plate 24.

The squeeze feet 29 are then lowered to press the molding sand S, i.e., to primarily squeeze it. The leveling frame 26 is then lowered, while the squeeze feet 29, the filling frame 32, and the flask F are together lowered toward the pattern plate 24, to secondarily squeeze the molding sand S.

The data-analyzing monitor means 54 of the molding monitor system 1 of this embodiment includes a processor, a display, a printer, and an indicator. The data-analyzing monitor means 54 is installed with software that graphs the detected pressures and so on. The printer may be selected, and is not essential. In the embodiment a personal computer is used as the data-analyzing monitor means 54.

The sensors 3 are connected to the data-analyzing monitor means 54 via a signal wire or wires 6, which transmit the signals created by the sensors 3 to an input/output board (not shown). The input/output board is a signal processing system for converting the signals from the sensors to signals convenient to it for processing them. Further, the data-analyzing monitor means 54 is connected to an external memory or storage (not shown), and the numerical data from the sensors 3 are memorized in the external memory or storage.

The operation of the embodiment arranged as above is now explained. FIG. 2 shows an example of the initial screen of the molding monitor of the data-analyzing monitor means 54. The monitor system can select any monitor function as required from many monitoring functions. When the molding machine 2 operates, any kinds of attributes relating to it are detected by the sensors 3, 3 and sent to the data-analyzing monitor means 54, and they are displayed on the display screen. Not only the detected values, but also the analyzed result produced by the data-analyzing monitor means 54 is displayed. Further, the settings on the attributes as required of the molding machine can be changed automatically, changed by any direct command, or changed from a remote place, according to the analyzed result.

When the settings are to be automatically changed, any data of the molding machine that produces good molds is memorized, and the data on each operation are then checked to see if they are within the allowable limits for the normal data. If they are not within the limits, an operation order to a controller of the molding machine 2 is automatically changed. Thus, a good mold is always produced.

When the setting is to be changed by a direct command, an operator directly changes the setting of the controller of the data-analyzing monitor means 54 or the molding machine 2. Similarly, an operator can change it from any remote place.

According to this embodiment, by daily storing in the memory or storage the data on regular or preventive maintenance of the molding machine 2, better maintenance can be kept, as, for example, excessive repairs, or stoppage of the product line due to excessive usage of the line, resulting finally in bad efficiency, can be prevented.

Seventh Embodiment

Another embodiment of the present invention is now explained by reference to some related drawings. In FIGS. 11 and 3 the molding machine 2 has sensors for detecting the attributes on the squeeze, i.e., sensors S1, S2, and S3 for detecting the pressures of the working fluids of the frame-setting cylinders 22, filling-frame cylinders 31, and the cylinders 26A for actuating the leveling frame 26, respectively. All other arrangements are similar to those of embodiment 1.

The operation of embodiment 7 arranged as above is now explained. In the molding monitor system 1 the function of the oil pressure may be selected from many monitoring functions in the screen 2 (shown in FIG. 2) of the data-analyzing monitor means 54 When the molding machine 2 operates, the function for monitoring the oil pressure displays the values of the working fluids of the frame-setting cylinders 22, filling-frame cylinders 31, and the cylinders 26A for actuating the leveling frame 26, which values are detected by the sensors S1, S2, and S3.

FIG. 4 shows an example of a graph displayed on the screen of the molding monitor of the data-analyzing monitor means 54. The molding machine 2 and the data-analyzing monitor means 54 display the attributes on the molding machine 2 detected by the sensors 3. Thus the status of the oil pressure can be monitored when the molding machine produces a mold.

Since in the seventh embodiment of this invention the oil pressures of the fluid of the frame-setting cylinders 22, filling-frame cylinders 31, and the cylinders 26A for the leveling frame 26 are collected from the molding machine 2 during its operation, the relationship between the produced mold and pressures is obtained. Thus each value of each oil pressure can be appropriately set. Further, since these values of these pressures are shown, the values for each pressure can be varied to produce a good mold.

In particular, since in the molding machine 2 of the seventh embodiment the characteristics of a produced mold, particularly, the hardness of the mold near the flask, change depending on the timing of lowering the frame-setting cylinders 22 and the leveling frame 26, it is important to detect the timing and display it when required. Namely, by selecting the appropriate timing for shifting from the primary squeeze to the secondary squeeze, a good mold is produced. Further, the timing of actuating the filling-frame cylinders 31 and the leveling frame is very important when demolding a produced mold. This timing can be changed automatically, changed by any direct command, or changed from a remote place.

When the timing is to be automatically changed, the pressure values of the frame-setting cylinders 22, the filling-frame cylinders 31, and the cylinders 26*a* for actuating the leveling frame 26 and their timing are memorized, and the data on each operation are then checked to see if they are within the allowable limits for the normal data. If they are not within the limits, an operation timing order to a controller of the molding machine 2 is automatically changed. Thus a good mold is produced.

Eighth Embodiment

In FIGS. 11 and 5 the data-analyzing monitor means 54 has sensors S4, S5, and S6 as sensors 3 for detecting the attributes on the pressures for the molding machine 2. These sensors S4, S5, and S6 detect the pneumatic pressure of the aeration from the central part of the sand hopper 28 or the air-jet chamber 27, the pneumatic pressure of the auxiliary air from above the sand hopper 28, and the pneumatic pressure in the flask F or the filling frame 32. All other arrangements are similar to embodiment 6.

The operation of the embodiment, which has the structure as explained above, is now explained. In the data-analyzing monitor means 54 of the molding monitor system 1 the function for pneumatic pressure may be selected from many monitoring functions. When the molding machine 2 operates, the function for pneumatic pressure receives signals from the pressure sensors S4, S5, S6, which act as sensors for detecting the attributes on the air pressures of the aeration and the auxiliary air, and the pressure in the frame, and send the data to the data-analyzing monitor means 54. This monitor means 54 displays the air pressures detected by the sensors 3 and monitors the pressures when the molding machine produces a mold.

FIG. 6 shows an example of the screen of the function for monitoring pneumatic pressure. The ordinate axis shows time, and the abscissa axis shows pressure. In the molding machine 2 of the embodiment of the present invention, which produces a mold retained in a flask, molding sand can be introduced into a mold space by using auxiliary air, the pressure of which is lower than that used for normal blow-squeeze. Thus, the molding machine uses aeration to fluidize the molding sand, wherein the auxiliary air and the aeration are balanced to enable small holes to be charged with molding sand, although such a charging cannot be achieved by the normal blow-squeeze, to enhance the uniformity of a produced mold. Accordingly, it is important to detect the pressures of the auxiliary air (the air in the sand hopper 28) and the air of the aeration and display them as required. Further, the state of the mold is memorized. By appropriately balancing the pressures of the auxiliary air and the air of the aeration as stated above, a good mold is produced. Further, the pressure of the air in the frame is very important in the molding using static pressure. Thus it is important to monitor the pneumatic pressure in the frame. If the aeration is not to be used, only the pressure of the auxiliary air and the pneumatic pressure in the frame may be detected.

Each value of each pneumatic pressure can be changed automatically, changed by a direct command, or changed from a remote place.

When it is to be changed automatically, the pressure values of the aeration and the auxiliary air, and the value of the pneumatic pressure in the frame of the molding machine that operates normally, and their timing, are memorized, and the data on each operation are then checked to see if they are within the allowable limits for the normal data. If they are not within the limits, the controller of the molding machine 2 is automatically ordered to change each pneumatic pressure. Thus a good mold is produced.

Ninth Embodiment

In FIGS. 11 and 7 the data-analyzing monitor means 54 has sensors 3 for detecting the attributes on the squeeze of the molding machine 2. These sensors 3 are position sensors S7 and S8 for detecting the positions of the frame-setting cylinders 22, the filling-frame cylinders 31, and the leveling frame. All other arrangements are similar to those of the embodiment 6.

The operation of the embodiment, which has the structure stated above, is now explained. In the molding monitor system 1 the function for monitoring positions may be selected from many monitoring functions. When the molding machine operates, the position-monitoring function can find information from encoders for the positions of the frame-setting cylinders 22, the filling-frame cylinders 31, and the leveling frame 26, and can monitor them.

FIG. 8 shows an example of a graph of the position-monitoring function of the data-analyzing monitor means 54. The ordinate axis shows the time, and the abscissa axis shows the displacement. In the molding machine 2 of this embodiment, by monitoring the positions of the frame-setting cylinders, filling-frame cylinders, and leveling frame, the height of the parting plane of the mold can be detected, and hence any defective mold can be found. Thus it is important to detect the positions of the frame-setting cylinders, filling-frame cylinders, and leveling frame, and to display the positions when required. In other words, by monitoring the positions of the frame-setting cylinders, filling-frame cylinders, and leveling frame, the height of the parting plane can be detected, and any defective mold can be found. If a defective mold is found, by memorizing the positions of the frame-setting cylinders and filling-frame cylinders, the cause or causes of the defect can be easily analyzed.

Further, the positions of the frame-setting cylinders 22, the filling-frame cylinders, and the leveling frame are changed automatically, changed by a direct command, or changed from a remote place. When automatically changed, the positions of the filling-frame cylinders and the leveling frame that are in the normal working status and their relationship are memorized, and the data for each operation are checked to see if they are within the allowable limits of the normal data. If not, the operation orders to the controller of the molding machine 2 are automatically changed for each hydraulic pressure of the filling-frame cylinders and the leveling-frame cylinders. Thus a good mold is produced.

In embodiments 7, 8, and 9 the hydraulic pressures, the pneumatic pressures, and the positions (displacements) are measured. By simultaneously detecting the hydraulic pressures and the positions, i.e., by simultaneously executing embodiments 7 and 9, a mold of a better quality can be produced. To that end, the molding monitor system may be arranged so that it can detect the hydraulic pressures of the frame-setting cylinders 22, filling-frame cylinders 31, and the leveling-frame cylinders, and the positions of the frame-setting cylinders 22, filling-frame cylinders 31, and the leveling frame. Further, if that molding machine is further provided with the sensors for detecting the pneumatic pressures of the aeration and the auxiliary air and the pneumatic pressure in the frame, which sensors are described in the related embodiments discussed above, i.e., if embodiments 7, 8, and 9 are simultaneously executed, the relationship between the sand charging and the squeeze would be more clearly understood, and the best molding monitor system would be arranged.

Tenth Embodiment

The tenth embodiment of the present invention is now explained by reference to FIGS. 12-17, and FIGS. 6 and 8.

Figure 12:
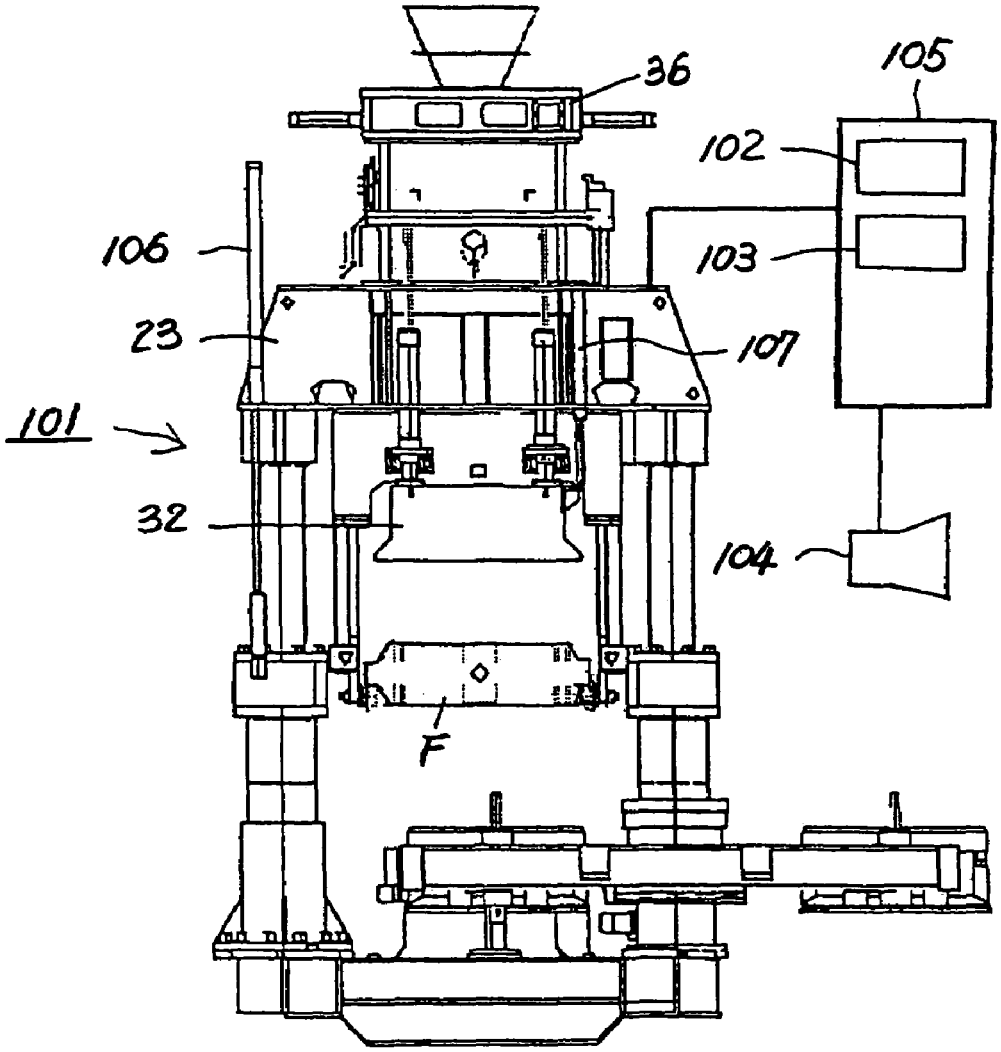
FIG. 12 is a schematic view of an embodiment of the molding machine to be applied to the present invention.

In FIG. 12 the molding machine 101 includes detecting means for detecting any change of the elements of the molding machine 101 over time; a first memory means 102 for memorizing the previously determined data on the elements as target data when the molding by the molding machine 101 that properly operates starts, a second memory means 103 for memorizing the data on the elements that are obtained with variations over time by the detecting means when a mold is actually produced by the molding machine 101, as the detected data; and a display 104 as display means for displaying the data of the first and second memory means 102, 103. The first and second memory means 102, 103 is a computer 105.

The detecting means includes hydraulic sensors for a hydraulic system that uses hydraulic fluid to actuate hydraulic cylinders (which are said elements), pneumatic sensors for detecting the pressure of the compressed air used for a molding sand charging device 15 (which is one of said elements), and encoder-type displacement measuring instruments 106, 107 for measuring the displacements of the vertically-movable supporting frame 23 and the filling frame 32 (these are said elements).

Figure 13:
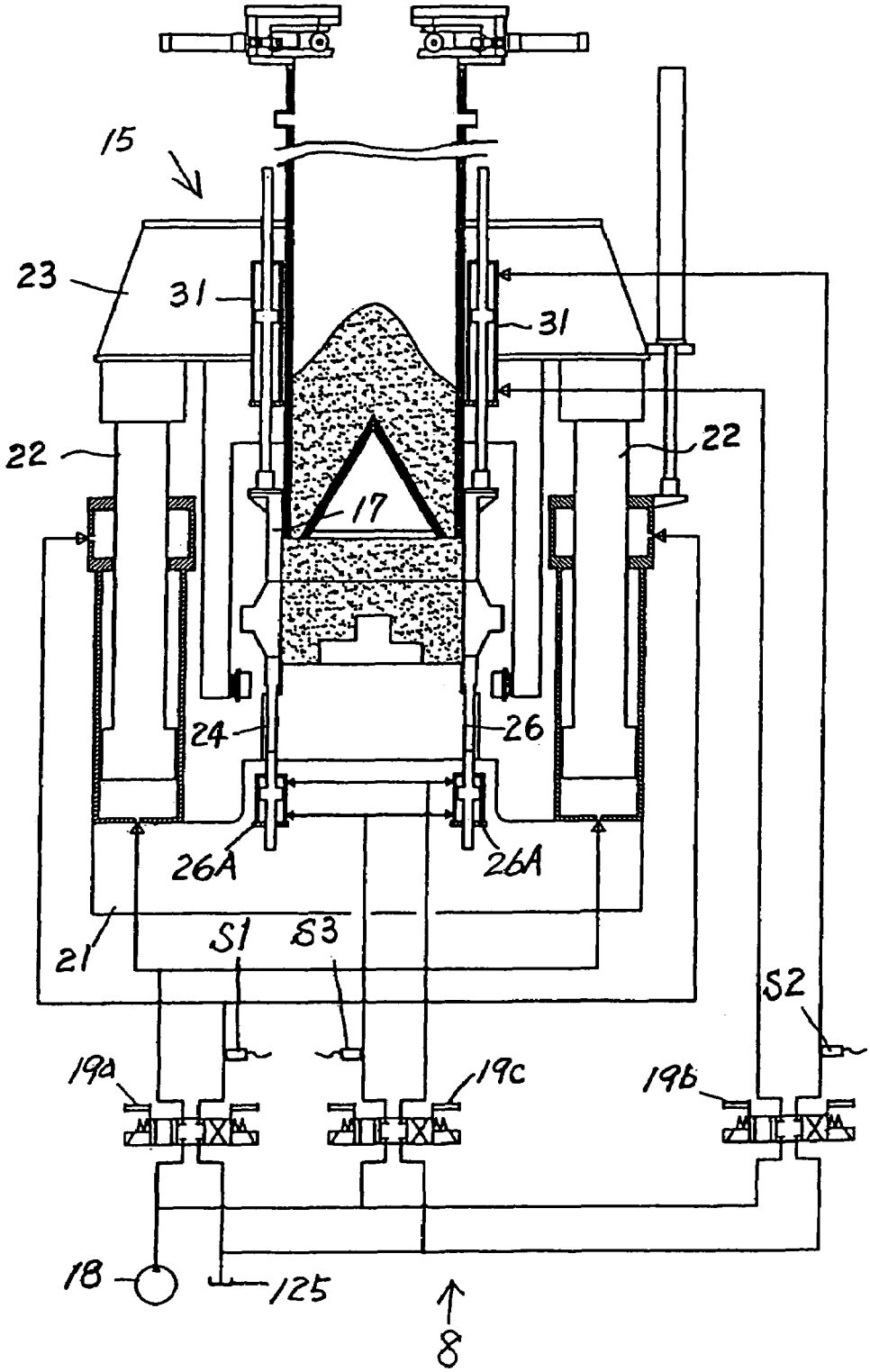
FIG. 13 is a schematic view of a main part, i.e., pressure sensors of the hydraulic system, of the molding machine of FIG. 12.

Further, the hydraulic sensors are provided to an oil-hydraulic circuit 8, as shown in FIG. 13. In detail, the pattern carrier 9 is disposed above and at the center of the platform-like machine base 21, and first, upwardly-facing, hydraulic cylinders (the frame-setting cylinders) 22, 22 are mounted on the base at the right and left thereof. An overhead frame 12 is installed across the distal ends of the piston rods of the first hydraulic cylinders 22, 22. This vertically-movable supporting frame 23 is lifted up or moved down by the extension or retraction of the first hydraulic cylinders 22, 22. Further, second, downwardly-facing, hydraulic cylinders 31, 31 are mounted on the sides of the molding sand charging device 15, which is mounted on the vertically-movable supporting frame 23. A filling frame 32 is installed across the distal ends of the piston rods of the second hydraulic cylinders 31, 31 such that it is vertically moved by extending and retracting the second cylinders 31, 31. Further, third, upwardly-facing cylinders 26A are mounted on the machine base 21 below and at the sides of the pattern plate 24 to lift a filling frame 32, which is loosely fitted around the pattern plate 24.

The first, second, and third hydraulic cylinders 22, 31, 26A are connected to said hydraulic circuit 8. This circuit is provided with a hydraulic pump 18, first, second, and third diverter valves 19*a* 19*b*, 19*c* for switching the supply of hydraulic fluid to the first, second, and third hydraulic cylinders, respectively, pressure sensors S1, S2, and S3 for detecting the pressures of the hydraulic fluids that circulate the first, second, and third diverter valves 19*a* 19*b*, 19*c*, respectively, and a tank 125.

Figure 14:
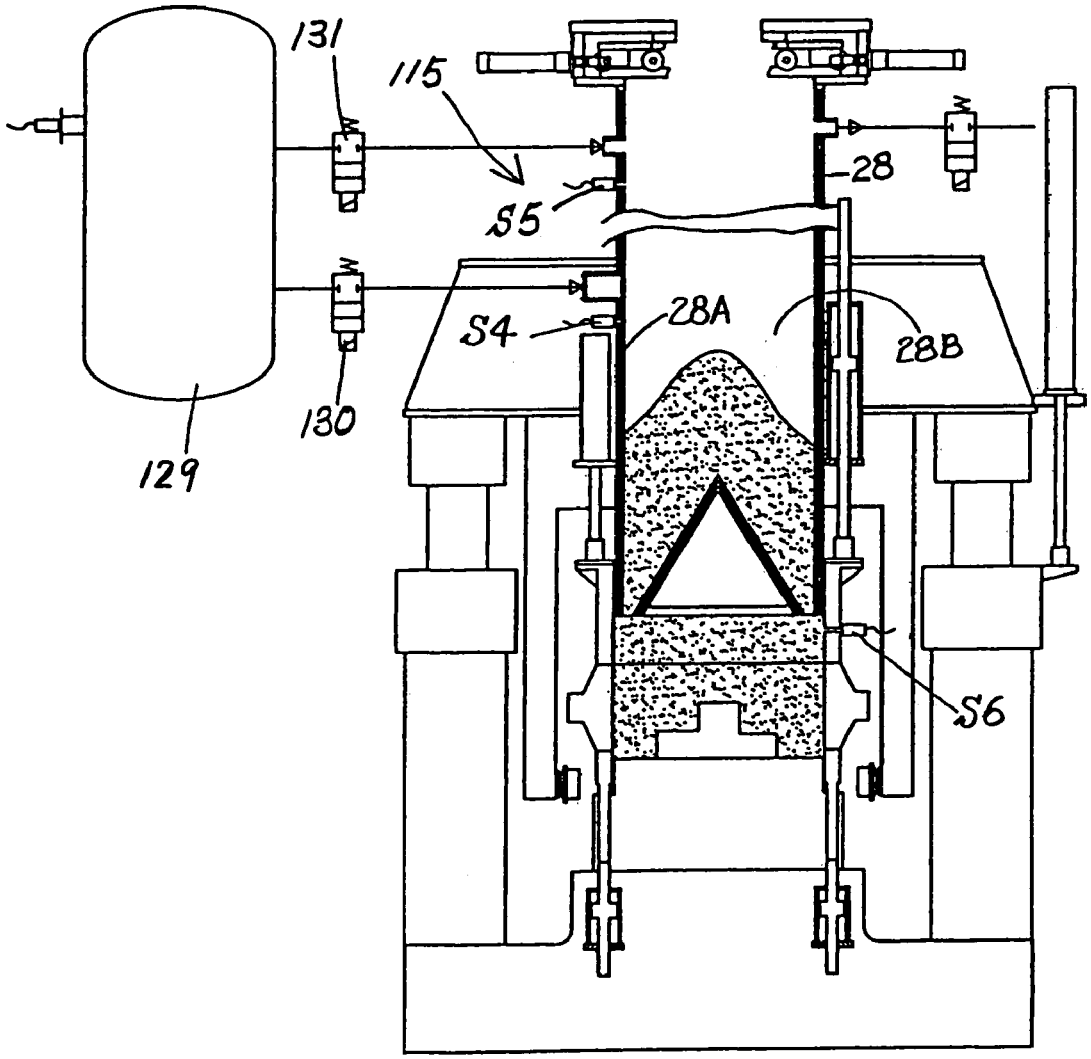
FIG. 14 is a schematic view of a main part, i.e., pressure sensors of the pneumatic system, of the molding machine of FIG. 12.

Further, about the pneumatic sensors, as shown in FIG. 14 an air chamber 129 is connected to the dual-structured sand hopper 28 of the sand-charging device 15 at the first space 28A and second space 28B via first and second on-off valves 130, 131. A fourth pressure sensor S4 and a fifth pressure sensor S5 are disposed at the first and second spaces 28A, 28B, and a sixth pressure sensor is disposed under the filling frame 32.

Additionally, in FIG. 12 "F" denotes a flask, and "36" an open/close mechanism disposed at the upper end of the sand hopper 28.

Figure 15:
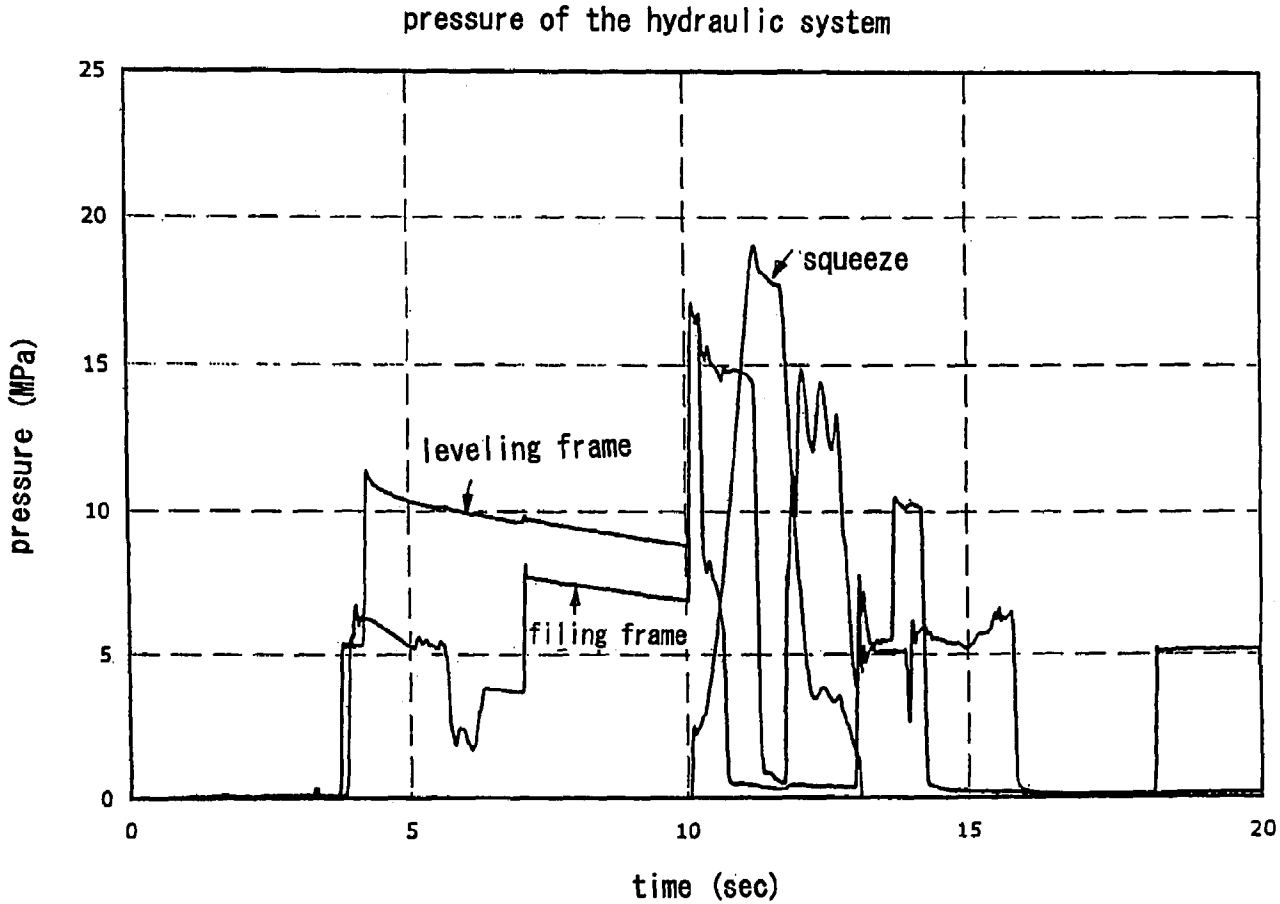
FIG. 15 is a graph showing an example of the result of detections over time by pressure sensors of the pneumatic system.

In the structure stated above, some elements start to operate when at the status shown in FIG. 13, and then complete the molding step. The results detected by the detecting means are displayed in real time by the display 104. Namely, the display 104 shows in real time the variations in the pressures of the first, second, and third cylinders 22, 31, 26A detected by the first, second, and third pressure sensors (for example, as shown in FIG. 15), the variations in the pressures of the air in the first space (the aeration) 28A, the second space (the sand hopper) 28B, and the filling frame 32 (as shown in FIG. 6), and the displacements of the vertically-movable supporting frame and filling frame (as shown in FIG. 6).

Figure 16:
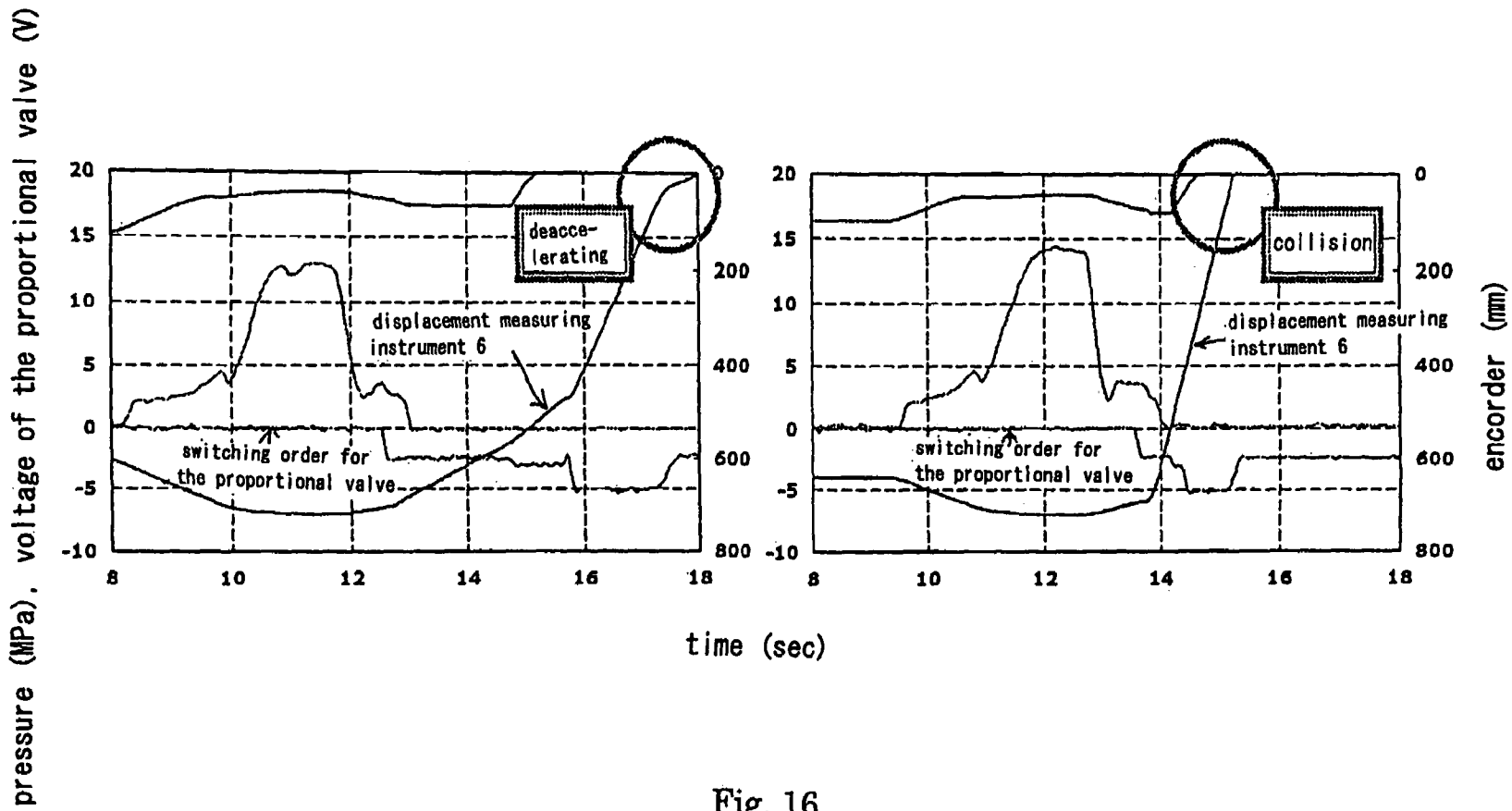
FIG. 16 is a graph showing examples of the result of the measurements or detections over time by the encoder-type displacement measuring instrument and the hydraulic pressure sensors.
Figure 17:
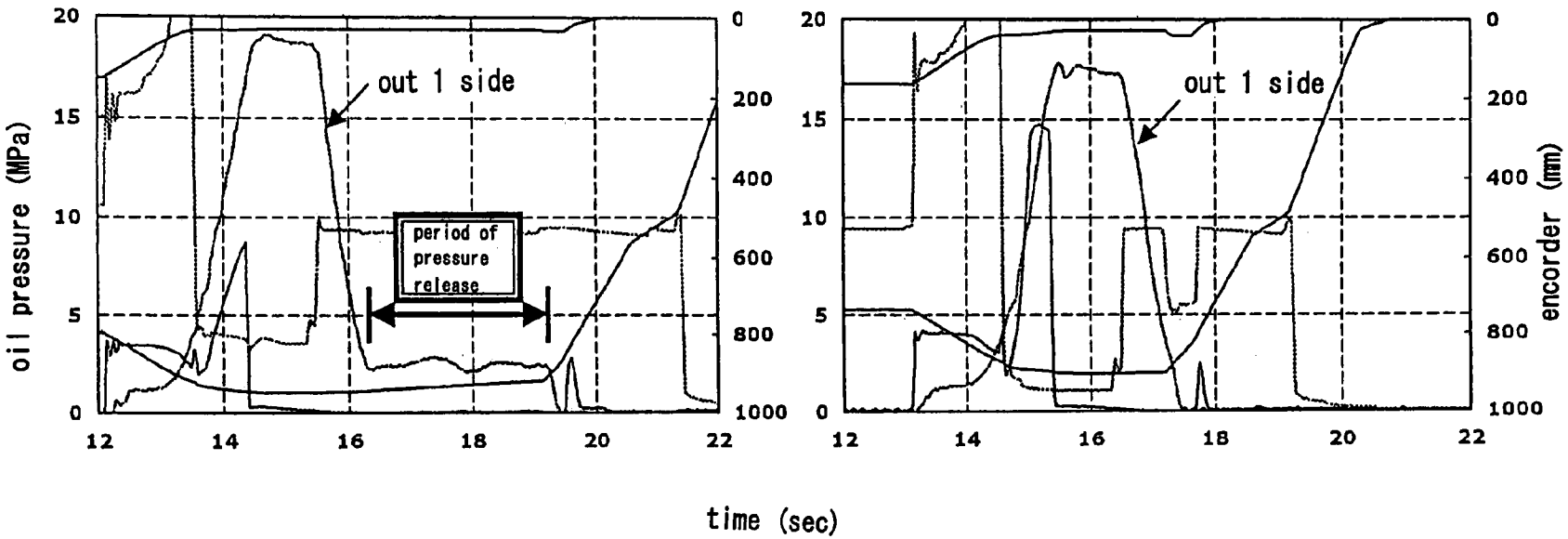
FIG. 17 is a graph showing examples of the result of the measurements or detections over time by the encoder-type displacement measuring instrument and the hydraulic pressure sensors.

Accordingly, by comparing the target data on the normally working molding machine 101 and the detected data on the variations over time in the elements when the mold is actually produced, both the target and detected data are shown on the display 104, and thus the cause of any abnormal element can be seen. For example, FIG. 16 shows an abnormal operation, wherein although the first hydraulic cylinders 22, 22 were instructed to execute the normal extending operation to deaccelerate just before their full extension (as shown in the left graph of FIG. 16), actually the first cylinders 22, 22 continued to extend without deaccelerating, notwithstanding the fact that the instructions on the value to the proportional valves were changed according to the values of the encoder. From this fact, it is estimated that the proportional valve were not responsive to the instructions and worked abnormally. Thus the valves were changed. The operation was then executed properly.

In another example, the degree of the extension operation of the first hydraulic cylinder 22, 22 was delayed. From this face, it is estimated that the normal extension of the cylinders was intended by trying to discharge the working fluid from out 2 while charging the pressurized fluid in out 1, as shown in the right graph of FIG. 17. But actually the discharge of the fluid from out 1 was incomplete and the oil pressure at out 1 was not lowered. This is the cause of the delay of the degree of the extension operation of the cylinders 22, 22. Therefore, a hydraulic circuit was added for discharging the fluid from out 1, and this resulted in eliminating the time loss for the degree of the extension.

All embodiments stated above are for the purpose of explanation, and the present invention is not limited to them. It will be clear to one skilled in the art that variations and modifications can be made to those embodiments without departing from the teachings of the appended claims and the spirit of the invention. Therefore, the claims are intended to include such modifications and variations.

The invention claimed is:

1. A method for monitoring molding when a sandmold contained in a flask is produced by a molding machine, comprising the steps of:

primarily squeezing molding sand by keeping an annular leveling frame at a specified height, which leveling frame surrounds a side surface of a pattern plate and slides vertically along the side surface, while lowering and advancing a plurality of squeeze feet into the molding sand;

secondarily squeezing the molding sand by lowering the squeeze feet, a filling frame and the flask together toward a pattern plate, wherein the method further includes the steps of continuously collecting data on the status of one or more molding operation cycles of the molding machine that is being operated; and communicating the collected data to a remote place to visualize the data on the status.

* * * * *